US006910284B2

(12) United States Patent
Romeiro de Aguiar et al.

(10) Patent No.: US 6,910,284 B2
(45) Date of Patent: Jun. 28, 2005

(54) WOOD ACCELERATING DRYING PROCESS BASED ON ITS RHEOLOGICAL PROPERTIES

(75) Inventors: Osmar José Romeiro de Aguiar, Belém (BR); Patrick Perré , Nancy Cedex (FR)

(73) Assignees: Empresa Brasileira de Pesquisa Agropecuaria-Embrapa, Brasilia (BM); Ecole Nationale du Genie Rural des Eaux et des Forets-Engref, Paris (FR)

( * ) Notice: Subject to any disclaimer, the term of this patent is extended or adjusted under 35 U.S.C. 154(b) by 86 days.

(21) Appl. No.: 10/257,030

(22) PCT Filed: Dec. 20, 2001

(86) PCT No.: PCT/BR01/00157

§ 371 (c)(1),
(2), (4) Date: Oct. 8, 2002

(87) PCT Pub. No.: WO02/49819

PCT Pub. Date: Jun. 27, 2002

(65) Prior Publication Data

US 2003/0099275 A1 May 29, 2003

(30) Foreign Application Priority Data

Dec. 20, 2000 (BR) ..... 0006399

(51) Int. Cl.[7] ..... F26B 3/00
(52) U.S. Cl. ..... 34/476; 34/426; 34/497
(58) Field of Search ..... 34/426, 428, 474, 34/497

(56) References Cited

U.S. PATENT DOCUMENTS 3,721,013 A * 3/1973 Miller ..... 34/265
3,939,573 A 2/1976 Berti
4,345,384 A * 8/1982 Pagnozzi et al. ..... 34/411
5,595,000 A * 1/1997 Goodwin, III ..... 34/471
5,901,463 A 5/1999 Guyonnet
5,992,043 A 11/1999 Guyonnet
6,248,402 B1 * 6/2001 Guyonnet et al. ..... 427/297

OTHER PUBLICATIONS

Boyd, J.D., "Tree Growth Stresses—Part V: Evidence of an Origin in Differentiation and Lignification," Wood Science and Technology, Berlin, v. 6, p. 251–262, 1972.

Dinwoodie, J.M., "Growth Stresses in Timber—A Review of Literature"., Forestry, London, v. 39, n. 2, p. 162–170, 1966.

(Continued)

*Primary Examiner*—Ira S. Lazarus
*Assistant Examiner*—Kathryn S. O'Malley
(74) *Attorney, Agent, or Firm*—Sughrue Mion, PLLC

(57) ABSTRACT

The objective of the present invention is an accelerated drying process for wood, capable of use with all species and of maintaining the quality of the dried wood intact, in which the temperature of the system is kept within the glass transition temperature range, for an appropriate period so as to attain the intended humidity ratio of the wood. It relates to an accelerated drying process for wood based on the rheological properties (hygro-thermalviscoelastic) of the latter, where the glass transition temperature of lignin is used as a relaxant or neutralization agent for the residual growth stress of trees, as well as those from the drying process. The process is controlled by monitoring the temperatures of the wood through the use of thermocouples placed along the length of the pieces. Furthermore, the use of the process of the present invention provides a significant reduction in the drying time and a reduction of the defects because molecular fluidity is maintained.

9 Claims, 7 Drawing Sheets

OTHER PUBLICATIONS

Galvao, A. P. M.; Jankowsky, I. P., "Secagem Racional Da Madeira", Sao Paulo, Nobel, p. 76–79, 1985.

Malan, F.S., Studies on the Phenotypic Variation in Growth Stress Intensity and its Association with Tree and Wood Properties of South African Grown *Eucalyptus grandis* (Hill Ex Maiden), Stellenbosch; University Stellenbosch, p. 143–145, 1984, PhD Thesis.

Mendes, A.S.; Martins, V.A.; Marques, M.H.B., "Programas De Secagem Para Madeiras Brasileiras", Brasilia, IBMA, 1998, 114p.

Milota, M.R., "Drying Wood: The Past, Present, And Future", International IUFRO Wood Drying Conference 6, 1999, Stellenbosch. Proceedings. (University of Stellenbosch, 1999, p. 1–10).

Perre, P., Ecole Nationale Du Genie Rural, Des Eaux Et Des Forets, ENGREF Nancy, Unite Produits Forestiers, 1984 (mentioning Krischer and Knoll, 1956).

Peyser, P., "Glass Transition Temperatures of Polymers", Polymer Handbook, 3$^{rd}$ Ed., v. 1, 1989.

Ponce, R.H.; Watai, L.T., "Manual de Secagem da Madeira", Sao Paulo, IPT, 1985, 72p.

Simpson, W.T., "Drying Wood: A Review—Part I", Drying Technology, v. 2, n. 2, p. 235–264, (1983–84).

Simpson, W.T., "Drying Wood: A Review—Part II", Drying Technology, v. 2, n. 3, p. 353–368, (1983–84).

* cited by examiner

WOOD ACCELERATING DRYING PROCESS BASED ON ITS RHEOLOGICAL PROPERTIES

This is a National stage entry under 35 U.S.C. §371 of PCT Application No. PCT/BR01/00157 filed Dec. 20, 2001; the above noted application is hereby incorporated by reference.

FIELD OF THE INVENTION

The present invention refers to a process for accelerated industrial drying of wood, for all species and thicknesses, based on the rheological properties (hygro-thermal-viscoelastic) of wood. In the actual drying stage, a temperature within the glass transition range (Tg) of lignin is used as a relaxant or neutralising agent, both for the residual growth stress of the trees, as well as those of the drying. The process is controlled by monitoring the wood temperatures through the use of thermocouples placed along the length of the pieces.

Through the use of the process of the invention, it is possible to obtain dry woods of high quality and in time periods shorter than those normally encountered in the industrial drying of woods.

BACKGROUND OF THE INVENTION

While vegetating, the quantity of water or the humidity ratio of the tree varies in accordance with the species, the locale and the season. Also, there are variations within the trunk (with the height and the distance between the medulla and the bark), being greater, generally, at the alburnum (from 80% to more than 200%) than within the heartwood(from approximately 40% to 100%). For the tree, water has a vital role, and its existence is indispensable. However, in wood, which is a hygroscopic material, the variation of the humidity ratio causes dimensional alterations. Its presence allows biological attacks, principally by fungae and insects, and impedes glueing or the finishing of manufactured products through the application of paints and varnishes. Thus, between living tree and the obtaining of the engineering material wood, a stage of removing water, or drying, becomes necessary.

The drying is the intermediate operation that most contributes to increase the value of the products manufactured from wood. However, it is one of the most costly stages in the transformation industry and, for this reason, there is a constant search for greater efficiency of the wood dryers and the actual drying process (JANKOWSKY, I. P. Improving the efficiency of dryers for sawn wood. Belém, 1999. A work presented at the IV International Plywood and Tropical Wood Congress, Belém, 1999. At print).

According to Ponce and Watai (see PONCE, R. H.; WATAI, L. T. Manual de secagem da madeira. [Manual for the drying of wood] São Paulo: IPT, 1985. 72p), the transformation of raw wood into products and consumer goods requires its prior drying for the following reasons: (i) it allows the reduction of dimensional movements to acceptable levels producing, in consequence, pieces of wood with more precise dimensions; (ii) it increases the resistance of the wood against fungi that cause stains and rotting and against the majority of xylophage insects; (iii) it improves the mechanical properties of wood, such as hardness, resistance to bending and compression; (iv) it increases the resistance of the splices and joints employing nails or screws; (v) it avoids the majority of flaws such as deformations, warping and splitting; (vi) it increases acoustic insulation properties and (vii) it facilitates the secondary beneficiation operations, such as turning, drilling and joining.

From the science and technology point of view, the concept of dry wood is a relative one, where a wood may be considered dry when its final humidity ratio is equal or less than the humidity equilibrium corresponding to its conditions of use (relative air temperature and humidity). This value will also depend on the type of product constructed from the wood and its use, as shown by Table 1 (Ponce and Watai, 1985).

TABLE 1

Final humidity ratio recommended for certain wood products.

| Product | Humidity ratio (%) |
|---|---|
| Commercial sawn wood | 16–20 |
| Wood for outdoor construction | 12–18 |
| Wood for indoor construction | 08–11 |
| Panels (plywoods, agglomerates, laminates, etc.) | 06–08 |
| Flooring and wainscotting | 06–11 |
| Indoor furniture | 06–10 |
| Outdoor furniture | 12–16 |
| Sporting equipment | 08–12 |
| Indoor toys | 06–10 |
| Outdoor toys | 10–15 |
| Electrical equipment | 05–08 |
| Packaging (crates) | 12–16 |
| Blocks for shoes | 06–09 |
| Firearm stocks and grips | 07–12 |
| Musical instruments | 05–08 |
| Agricultural implements | 12–16 |
| Boats | 12–18 |
| Aircraft | 06–10 |

The humidity ratio or quantity of water in the wood (U) is defined by the ratio between the mass of water present in the wood ($m_a$) and the dry mass ($m_s$). In this manner, it is possible to obtain the following expression:

$$U=m_a/m_s$$

Where the total mass of the sample is represented by ($m_u$), therefore:

$$U=(m_u-m_s)/m_s$$

Usually, the humidity of wood is expressed in terms of percentual, thus;

$$U\%=[(m_u-m_s)/m_s]*100$$

By convention, the dry mass is obtained after the wood undergoes a drying in an oven at 105° C., until its stabilisation or constant weight.

Another very important parameter referring to humidity of wood is the Saturation Point of the Fibres (SPF) also known as the Cellular Wall Saturation Point. This is defined as the quantity of water necessary to saturate the cellular walls without leaving water free within the lumen. The humidity of the Saturation Point of the Fibres falls around 25 to 30%, depending on the plant species. Humidity above the SPF refers to the ratio of free water, also known as the green lumber stage, and, below the SPF refers to the hygroscopic or bonding water.

In consequence of alterations of the humidity below the SPF, dimensional variations of wood occur, meaning the contraction and expansion of the piece of wood, which occur due to the decrease or increase of the humidity, respectively.

This dimensional variation manifests itself in the three planar directions of the wood; the longitudinal, the radial and the transversal, which may be:

linear: that which develops along the three directions of the wood, having as unit of measure, the length (m) and volumetric: expressed in volume ($m^3$), resulting from the sum of the three variations.

Possessing anisotropy (characteristic behaviour of wood), that is, different physical and mechanical properties on the longitudinal, radial and tangential plans of the tree trunks, the drying contractions are, generally, in the order of x in the radial direction, 0.1x in the longitudinal direction and 2x in the tangential direction. Thus, as the drying contractions are not equal in all directions, it is possible that there occurs a major change in the original shape of the piece, causing the appearance of deformations (warpages) and splits.

Considering the quality of the dried wood, the defects may be, according to Mendes and collaborators (1997) (MENDES, A. S.; MARTINS, V. A.; MARQUES, M. H. B. Programas de secagem para madeiras brasileiras. Brasília: IBMA 1997.114p):

Superficial Fissures: the superficial fissures appear when the traction stresses perpendicular to the fibres exceed the natural resistance of the wood, due to an excessively accelerated initial drying (high temperature and low relative humidity of the air). In these conditions, an excessive drying of the surface layers occurs, rapidly attaining low humidity values for the wood (inferior to the saturation point of the fibres), whilst the internal layers retain more than 30% humidity. This produces significant differences in the ratios of humidity between the surface and the centre of the wood (surface under traction and interior under compression), which may be aggravated by the anisotropy of the dimensional variations. The thicker the piece of wood, the greater the possibility of surface fissures occurring. These happen mainly in the initial phases of drying.

Splits at the Extremities or Ends: these are caused by the extremities drying faster when compared to the rest of the piece of wood. They occur, normally, at the beginning of drying.

Internal Fissures or Honeycombs: these appear during the drying, when the traction stresses develop in the interior of the piece (surface under compression and middle under traction) or reversal of the stresses. These stresses cause internal fissures when the efforts exceed the cohesion forces of the wood cells.

Superficial Hardening: during industrial drying there commonly occurs the development of compression stress at the surface and traction stress on the inside of the piece of wood, caused by the occurrence of a humidity gradient across the thickness. If these compression and traction forces are above the proportional limit (elastic limits) of the wood, residual deformations may occur that remain even when the humidity gradient across the thickness is eliminated.

Warping: this is any distortion of the piece of wood in relation to the original planes of its surfaces. Thus, taking into consideration the planes in relation to which alteration occurred, the warps may be half-pipe, longitudinal and twists. Although a large part of all deformations are frequently developed during drying, the control of the process and the conditions of drying are not always responsible for such deformations. This phenomenon may occur due to the innate properties of the wood, being inherent to its place of vegetative development. By definition of drying defects, such deformations are not part of the quality control, but rather are part of the quality of the wood. Mendes and collaborators, 1997, mention that, whilst little can be done to minimise the appearance of warps, it is possible to render the drying programs less severe (reducing the drying potential of each stage of the process), and also, very low final humidity ratios should be avoided, as the contraction of the wood increases with the decrease of the humidity ratio. In this sense, uniformity is important as it helps avoid that only a part of the load presents a ratio of humidity greatly below the desired level. Generally, the most efficient procedures to reduce warping are: adequate distribution, correct stacking with a perfect vertical alignment of the chocks, prior drying in open air before drying in the oven and restraint of the load by means of weight placed on top of the stack or traction of the stack with springs.

To minimise the prejudicial effects of the drying contractions of the wood in the quality of the final product it is necessary, before manufacturing the product, to reduce the initial humidity to a humidity corresponding to the surrounding conditions at the place of use.

However, the drying of the wood before the first transformation (production of planks, plys/laminates and chips) becomes impossible for the following reasons: (i) the geometric dimensions are inadequate (wood in logs) for undergoing controlled drying and are difficult to handle inside the drying equipment and (ii), due to the anisotropy, the differentiated contractions induce a series of deformations that are not compatible with the geometry, thus provoking the formation of fissures.

In practice, the drying of wood must be, therefore, undertaken after the first transformation and before all the further stages such as the beneficiation and the finishing.

The first attempts at drying wood date to the beginning of the 18th century with the use of the Cumberland method in which the wood was placed in the midst of wet sand to be curved and/or dried through the action of heat until attaining the suppleness and humidity desired.

At the end of the 19th century and the beginning of the 20th century industrial dryers already showed similar characteristics to those of today. Humid air began to be employed to control the drying speed of the wood producing, in this manner, a dry product of better quality.

The last and most important advance in the mechanical construction of wood dryers occurred in 1926 (see MILOTA, M. R. Drying wood: the past, present and future, In: INTERNATIONAL IUFRO WOOD DRYING CONFERENCE 6., 1999 Stellenbosch. Proceedings. University of Stellenbosch, 1999. P. 1–10, quoting Koehler, 1926), where the dryers began to have reversible air circulation and an automatic control device regulated by clock. As previously mentioned, the drying method presently employed is very similar to those of the 20's and 30's. The dryers have become larger allowing an increase in the volume of the dried wood per drying unit. The air heating pipes are now in the form of coils (radiators), the ventilators are placed in the upper part with the purpose of better ensuring air velocity, the humidity may be increased by the spraying of water or by the injection of saturated steam or, also, reduced through the partial renovation of the air within the drier or using the principle of condensing the air and, in the majority, computers are employed to control the process.

However, despite all the evolutions of recent years, if one were to chose a single plank randomly from a stack of dry wood, it would probably not be possible, with any degree of certainty, to know if it had been dried with the technology of the 30's or that of today. This does not mean that researchers have done nothing since 1930. Certainly, today, there is better knowledge of how water is distributed in wood and how it moves in it (Milota, 1999).

According to Krischer and Kroll (1956), quoted by Perré (1994), there are three distinct stages, from the physical aspect, during the drying process of wood, as follows:

First Stage: the drying speed is constant, thus, the evolution of the time for the loss of the mass of humidity in wood is linear. This phase commences after the stabilisation period of the thermal process and proceeds whilst the surface of the wood is irrigated with free water resulting from capillary action and the effect of internal gas pressure. During this phase, the speed of drying depends on the velocity and temperature conditions of the air, as well as the temperature of equilibrium of the wood with the humid air temperature.

Second Stage: it commences when the surface of the wood enters the hygroscopic phase. The speed of drying in this phase decreases. The temperature of the wood increases, starting at the surface, and approaches the dry air temperature.

Third Stage: theoretically, it commences when the wood is totally in hygroscopic phase. The speed of drying shows at this moment a new reduction, tending towards zero. The drying is completed when the temperature of the wood equals the dry temperature and the air humidity equals the equilibrium temperature of the wood (determined by the desorption isotherm).

Furthermore, many drying programs were developed and presented to the industrial sector in an attempt to improve the quality of the drying. These programs were created taking into consideration the differentiated behaviours of woods during drying, resulting from the heterogeneity of the physical, mechanical, chemical and anatomical characteristics of woods amongst species and even within the same species of tree.

The programs for industrial drying of wood may be of the following types: humidity-temperature, time-temperature, or based on the gradient for drying, also called the potential for drying (Rasmussen, 1968; Branhall & Wellwood, 1976 and Hidebrand, 1970, quoted by Galvão & Jankowsky, 1985 (see GALVÃO, A. P. M.; JANKOWSKY, I. P. Secagem racional da madeira. São Paulo. Nobel, 1985. 112p).

With the development of automation and the computerised control of the process, the humidity-temperature type programs came to the forefront of the wood drying industry sector, followed by those employing the gradient for drying, in accordance with Table 2.

TABLE 2

Traditional program or table for drying used for Pinus spp., aiming a final humidity ratio of 13% (Galvão & Jankowsky, 1985).

| Stage/ (Humidity of the wood) | Dry bulb temperature ($T_s$) | Wet bulb temperature ($T_u$) | Hygrometric difference ($T_s$–$T_u$) | Relative humidity of the air (UR) | Equilibrium humidity (UE) (%) |
|---|---|---|---|---|---|
| Heating | 60.0° C. | 59.0° C. | 1.0° C. | 95.0% | 20.6% |
| >60% | 60.0° C. | 55.5° C. | 4.5° C. | 80.0% | 13.1% |
| >60%/50% | 60.0° C. | 54.5° C. | 5.5° C. | 75.0% | 12.0% |
| >60%/40% | 60.0° C. | 52.0° C. | 8.0° C. | 65.0% | 9.8% |
| >60%/30% | 65.0° C. | 53.0° C. | 12.0° C. | 55.0% | 7.7% |
| >60%/20% | 75.0° C. | 57.5° C. | 17.5° C. | 40.0% | 5.5% |
| Uniformity | 75.0° C. | 69.0° C. | 6.0° C. | 76.0% | 11.0% |
| Conditioning | 75.0° C. | 73.0° C. | 2.0° C. | 92.0% | 16.0% |

Generally the programs are divided, systematically, into three stages:

stages of initial heating: this phase has the purpose of causing the heating of the drying chamber of the oven and the load of wood without allowing, however, the actual drying process to commence. High relative humidity is employed;

stages of actual drying: in this phase the removal of the humidity from the wood occurs. According to Galvão & Jankowsky (1985), low temperatures should be used during the removal of free water (40 to 60° C.) along with high relative humidity (85%). To avoid the occurrence of collapses in the species that dry with difficulty it is advisable to use a relative humidity above 85% and an initial temperature of around 30° C. It is also suggested that around ⅓ of the initial humidity should be taken as reference for commencing the reduction of the relative humidity. The temperature of the dry thermometer should be maintained constant until all the free water has been removed from the wood. The maximum values depend on the species and the thickness of the wood, thus, for greater thickness lower temperatures should be adopted. For humidity below 30% the dry temperatures may be considerably raised. The time period of this phase will depend on the density of the wood, the thickness of the piece, the temperature used and the humidity gradient, and the stages of uniformity and conditioning: the uniformity phase may be dispensed with depending basically on the quality of the drying. But, the principal purpose is the uniformity of the humidity that occurs between the pieces of the load of wood. In the final stages of drying, the possibility of obtaining a humidity ratio that is similar for all the pieces is remote. The aim of the conditioning phase is the elimination of the internal stresses, Basically, this operation consists of significantly raising the relative humidity of the air in a manner as to cause a new humidification of the surface layers of the pieces, making the humidity gradient less abrupt or, also, increasing the temperature (up to approximately 100° C.) to release the stress gradients caused by drying.

The patent U.S. Pat. No. 3,939,573 describes a drying process for wood at low temperature. The drying of the wood consists the following two stages: (i) employing an air temperature of around 20 to 30° C. until a humidity percentage varying between 16 and 25% is obtained, and (ii) raising the temperature to around 34 to 38° C. and maintaining it thus until obtaining the desired humidity ratio of the wood. This process takes as principle the use of drying temperatures similar to those normally encountered in natural conditions (on average 30° C). In this manner it is hoped that the mechanical resistance of the wood is not compromised. On the other hand, due to the low temperatures used, this process presents a long drying time and there are frequent occurrences of defects such as end splits. Furthermore, the woods submitted to this treatment, due to the surrounding conditions of the drying (high humidity and average temperature of 30° C.), are subject to attack by the fungi that cause stains.

As an example of thermal treatment at high temperature it is possible to quote the patent document WO 94/27102. This describes a drying process for wood consisting of the following stages: (1) thermal treatment at a temperature of at least 90° C., preferentially at least 100° C., and maintaining this temperature until the humidity ratio of the wood attains levels below 15% and (2) an increase of the temperature to values above 150° C. (preferentially between 180 and 250° C.) until the weight variation of the treated product attains around 3% at least. In this process, the use of high temperatures demands constant control of the temperatures on the surface and inside the wood, thus, maintaining the difference between these temperatures at around 10 to 30° C. If these conditions are not respected, the wood will present a series of defects such as fissures and warps.

The U.S. Pat. No. 5,992,043 patent proposes a thermal treatment for wood, with the aim of increasing the biological resistance and reducing the hygroscopicity. This process has three stages, illustrated graphically as zones "A", "B" and "C". The first stage, corresponding to zone "A" is a conventional drying stage where the temperature of the oven is progressively increased to about 80° C. The intermediate stage, corresponding to zone "B", is a stabilisation treatment where the temperature is raised from the drying temperature of 80° C. to the glass transition temperature of dried wood which, in the present case, is the average between the temperature of lignin and of hemicellulose and which, according to literature, is normally above 150° C. It is mentioned that in this zone "B" (in the diagram, between 120 minutes and the td), the only object is the dimensional stability of the wood. The last stage, corresponding to zone "C", also called drying or curing stage (curing treatment), consists in raising the temperature of the wood to around 230° C.

In this process, however, due to the use of an approximate value for the glass transition temperature—thus the average between the glass transition temperature of lignin and of hemicellulose in stage "B"—it is not possible to guarantee when treating more problematic woods (such as *Quercus rubro* and Eucaliptus spp.) the mechanical qualities of the material. Furthermore, during "C", an elevation of the temperature occurs to values above that of glass transition, in this case approximately 230° C., to complete the thermal treatment of the wood, a process also know as roasting.

The woods resulting from such processes are intended for different uses than those woods that undergo conventional industrial drying process. Generally, when drying wood, with the exception of some conifers of temperate climates, temperatures above 100° C. are not employed (see Mendes et al., 1988).

It is important to highlight that despite all efforts undertaken to search for more uniform programs that comply with the difficult compromise between duration of the drying, consumption of energy and quality of the final product, the industrial drying of wood still leaves much to be desired. To date, only the experience of the drier operators, through the use of their empirical knowledge, has allowed anything close to this difficult compromise. This problem is aggravated, mainly when considering woods known to be problematical, as in the cases of the woods *Quercus rubro* and Eucalyptus spp.

In this manner, more efficient and profitable processes are being sought, capable of guaranteeing the physical and mechanical qualities of wood and allowing the use of a drying process that is the same for all species.

Therefore, the importance of a refined process for the drying of wood based on the neutralisation of the growth stresses, as well as those due to drying, through the use of the rheological properties of wood, becomes evident. This is the objective of the present invention.

SUMMARY OF THE INVENTION

The objective of the present invention is a process for the accelerated drying of wood, capable of being used with all species and of maintaining intact the quality of the dried wood, in which the temperature of the system is kept at a value encountered within the temperature range of glass transition, for the period of time appropriate to attain the humidity ratio intended for the wood.

The preferred embodiment of the present invention refers to an accelerated drying process for wood based on the rheological properties of the latter, where the glass transition range of lignin is employed as a relaxant agent for the residual growth stresses of trees and those occurring from the drying process.

Furthermore, the use of the process of the present invention provides a significant reduction in the drying time and a reduction of defects because molecular fluidity is maintained.

DETAILED DESCRIPTION OF THE INVENTION

Figure 1:
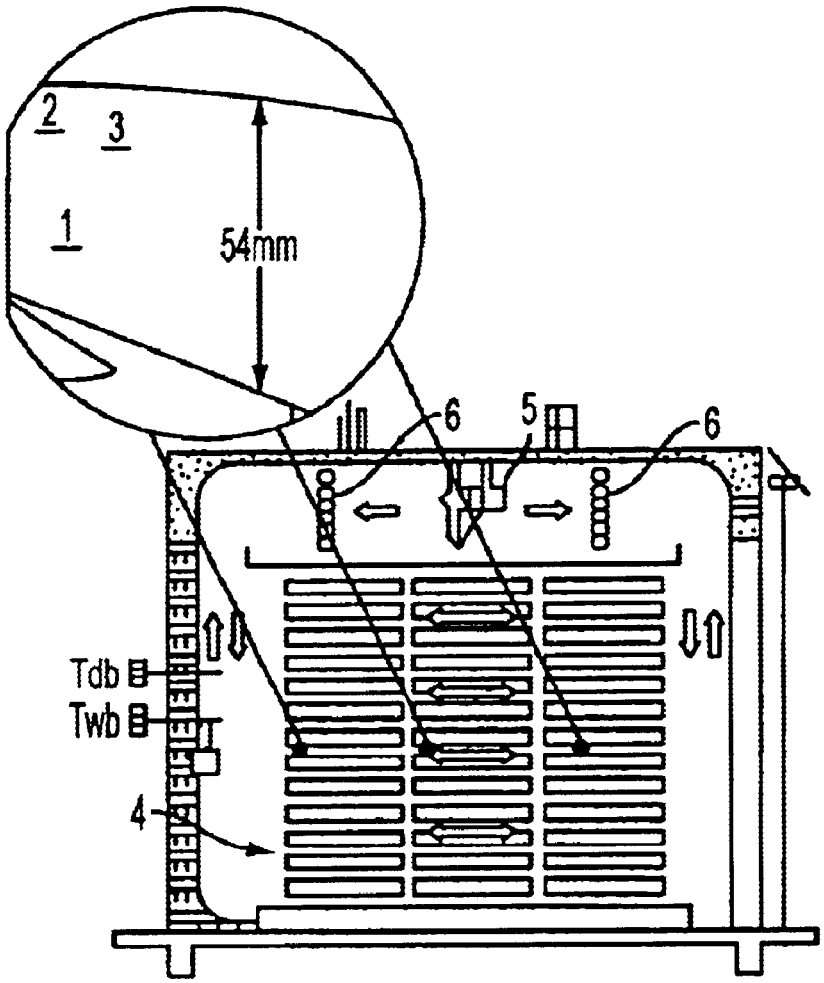
FIG. 1: illustrates an industrial wood drier and the technique used, during the drying process, to measure the temperature within the wood through the use of thermocouples.

To facilitate the comprehension of the invention, the following recognised definitions for some of the terms used here are supplied:

1. Industrial wood drying process: in specialised literature, the industrial drying process or drying program for sawn wood is defined as a sequence of interventions or actions which occur within the drier, during the drying, through the control of the temperature and the relative humidity of the air, whose final objectives are to attain the difficult compromise between the duration of drying, consumption of energy and quality of the final product.
2. Lignin: natural polymer with a rather complex, amorphous and resistant structure. It impregnates the cells of the vegetable (the fibres, vessels, tracheids), rendering them impermeable and non-extensible. Its molecules are formed by chains or networks constituted from units of phenylpropane of different non-hydrolisable types. A colourless substance, insoluble in water or in organic solvents, it provides rigidity and durability to the wood.
3. Glass transition temperature—Tg: relates to an important phenomenon that determines the physical behaviour due to the temperature of the non-crystalline systems. This phenomenon refers to these systems in an ample sense (for example, mineral glasses and polymers). In fact, it is a transition from solid type behaviour to liquid type behaviour. All the physical properties of the material (specific volume, viscosity, modulus of dynamic elasticity, conductivity, amongst others) suffer important modifications when their temperatures approach glass transition temperature. In this manner, the Tg is considered to be a fundamental parameter for the physical characterization of a material. Below the Tg, the secondary bonds connect the molecules amongst themselves to form an amorphous rigid solid. Above the Tg, the secondary bonds between the molecular chains of the polymer melt and enter, initially, a viscoelastic state and, later, a viscous state where it is capable of undergoing great elastic deformations without rupturing. The interval of temperatures for each transition is of approximately 15 to 25° C., which reflects the nature of the transition phenomenon.
4. Rheology: it is the science that deals with the molecular flow of the deformations of the materials under the action of stresses (mechanical demands), with the objective of describing and explaining the properties of materials that present an intermediate behaviour between perfect elastic solids and newtonian liquids.
5. Wood Rheology: is the science of understanding, describing and predicting the mechanical behaviour of wood and derived materials within an exposure environment where these may be subjected to variations in time, temperature, humidity and mechanical demands.
6. Solid substance: a substance is considered to be solid when, being submitted to a constant stress which, however, does not provoke its rupture, tends to a state of static equilibrium in which its deformation continues constant.
7. Liquid substance: is that which when submitted to constant stress will never attain a state of static equilibrium. Its deformation increases indefinetely, thus, the substance flows.
8. Fluency of wood: is a demonstration of its viscoelastic and plastic behaviour related to its nature as a biopolymeric natural compound (50% cellulose, 25% hemicellulose and 25% lignin). It concerns the development of deformations caused by the joint action of the combined stresses kept constant over time and by the molecular fluidity of its polymers. With the removal of these stresses the deformation will tend to return to its initial position.
9. Relaxation: the phenomenon responsible for the progressive disappearance of the state of stress in a body, to which a limited and constant stress was applied and maintained, caused by the molecular flow.
10. Polymer: chemical compound or mixture of compounds, consisting essentially of repetitive units, formed through a chemical reaction, known as a polymerisation, in which two or more small molecules combine together to form larger molecules, or macromolecules.
11. Free water: is that which exists within the empty parts of wood such as the lumes of the tracheids, the vessels, the fibres, the parenchyma, amongst others, as well as the intercellular spaces. It is retained in the wood by the means of capillary pressure.
12. Bonding or hygroscopic water: is that which is retained in the wood between the cellular walls by hydrogen bonds or by van der Waals type bonds.
13. Constitution water: is that which is part of the chemical constitution and in order to be eliminated it is necessary to destroy the wood by carbonisation.

Wood is a product of the xylematic tissue of superior vegetables found, generally, in the trunk and branches of trees, with cells specialized in the support and transport of sap.

The xylem is a structurally complex tissue composed by a combination of cells with differentiated forms and functions, and is the main water conductor tissue in vascular plants. It also possesses the properties of being a conductor of mineral salts, of storing substances and of sustaining the vegetable. It is important to highlight that xylem is encountered in various regions of the vegetable such as the roots or fronds and not just in the stem.

From the chemical point of view, xylem is a tissue composed from various organic polymers. The cellular wall of xylem takes cellulose as its structural basis. Apart from cellulose, wood also contains hemicellulose, formed from many combinations of sugar pentose groups (xylose and arabinose). In certain aspects it differs from cellulose (principally in structure, degree of polymerization and molecular weight), but they are similar. After cellulose, lignin is the second most important constituent of wood, and it is a complex molecule with a high molecular weight responsible for conferring wood resistance to mechanical efforts.

To maintain the development, growth and natural balance of the tree the external part of the trunk, close to the bark, is under traction stress, whilst the central part is under compression stress. This set of forces is called the growth stress of a tree. They are distinct from the deformations that occur in wood as a result of the elimination of the water by the drying process (see DINWOODIE, J. M. Growth Stresses in timber: a review of literature. Forestry, London, v. 39, n. 2, p. 162–170, 1966).

After felling the tree, part of the growth stresses are released, especially those close to the cuts and that, most often, are responsible for the appearance of end splits in the logs, a characteristic that has limited the use of the prime part of the wood of the eucalyptus. During the production of planks in the sawmills, another important part of the stresses are released and result, at this moment, at the onset of the residual growth stress.

The growth stresses are originated during the development of the secondary cell walls caused by the differentiation of the xylem in the polymerization stage of the lignin.

In the lignification process, the lignin is incorporated between the microfibrils of the cellular wall, causing a longitudinal contraction in the cells as a result of their radial expansion which, according to Jacobs, 1945 (JACOBS, M. R. The growth stresses of wood stems. Bulletin. Commonwealth Forestry Bureau, Canberra, v. 28, p. 1–67, 1945), Boyd, 1950 (BOYD, J. D. The growth stresses: V. Evidence of an origin in differentiation and lignification. Wood Science and Technology, Berlin, v. 6, p. 251–262, 1972) and Dinwoodie, (1966) are the origin of growth stresses.

Because the new xylem is in contact with the older (mature) differentiated xylem, there begins, progressively, a longitudinal compression growth stress in the center of the log, with its peak at the medulla (see MALAN, S. F. Studies on the phenotypic variation in growth stresses inteunty and its association with tree and wood properties of South African Grow. *Eucalyptus grandis* (Hill ex-Maiden). Stellenbosch: University Stellenbosch,. 1984. PhD Thesis).

Despite being studied world wide, growth stress are not yet associated to drying defects, and they are mainly believed to be due to those definitions previously presented by Dinwoodie, 1966.

Generally, there are two types of industrial drying processes: (i) the traditional or low temperature process, where the removal of water occurs by molecular diffusion in the boundary layer or by vaporisation and, (ii) the high temperature drying process, where the removal of water occurs when the partial pressure within the wood becomes superior to the atmospheric pressure, therefore expelling the humidity from the wood, in the form of liquid water and vapour. Both these types of drying may cause flaws.

Whilst developing the research that originated in the present invention, it was established that the flaws that occur in wood during the drying process are, generally, related to drying stress, and may or not be related to growth stress. These, in turn, are caused by hydrostatic or capillary stress and by differentiated contractions, caused due to the humidity gradients and the anisotropy of wood (see SIMPSON, W. T. Drying wood: a review. Drying Technology; v. 2, n. 2, p. 235–264, v. 2, n. 3, p. 353–368, 1983/1984 and; Galvão and Jankowsky, 1985).

The capillary stress develop in the cell walls when the lumen are still full of water and are governed by the following equation:

$$T=2S/R$$

Where T is the capillary stress, S is the surface and R is the radius.

The capillary stress leads to a flaw known as a collapse. When the radius of the capillaries are equal or inferior to 0.1 $\mu$, the stress may attain 1400 kPa. This may exceed the proportional limit in certain species, when submitted to high temperatures. The result is an inward collapse of the cell walls, which is revealed by undulations of the wood surface.

On the other hand, the differentiated contractions are due to the anisotropy of the contractions of the radial, tangential and longitudinal planes of the wood, or also, as a result of humidity ratio gradients when the wood is in the process of drying.

In this manner, with the intent of minimising the above mentioned flaws, the refined process of the present invention is based on the neutralisation or equilibrium of the residual growth stress, when present, and of the inevitable drying stress, through the use of the rheological properties of wood.

Employing the present invention it is possible to use drying temperatures superior to those recommended in traditional drying processes without, however, compromising the quality of the wood.

It is important to point out that through the use of this invention, the actual drying phase occurs at a temperature within the glass transition temperature range of lignin, without the risk of the hygro-thermal-mechanical degradation of wood such as, for example, the familiar physico-chemical phenomenon of hemicellulose hydrolysis.

Furthermore, it is possible to significantly reduce the drying time, which may vary between 40 and 60%, as well as reducing the flaws which, despite that the majority of these do not exceed 1% because of molecular fluidity, are significant in species which are considered to be problems for drying.

The process being described is adequate for all species of woods and includes four basic phases, as follows: loading the drier, heating the load, actual drying and cooling.

The loading process of the drier naturally follows the traditional processes for drying, being however, known to people versed in the matter. The same care should be taken such as, for example, the alignment of the stacks inside the oven.

The second phase, or the heating of the load of wood inside the drier is undertaken using a manual or automatic process control system that allows a gradual heating, for the time period necessary to attain the Tg. Thus, in this phase, significant temperature gradients between the center and the surface of the wood should be avoided, so that the difference between the temperature of the center and the surface remains around 2 and 5° C., according to the precision of the control system of the process and the thickness of the pieces. With the heating there is a release of the possible residual growth stress, in consequence of a phenomenon known as relaxation. In this phase, a temperature within the glass transition (Tg) range of lignin is used, together with a humidity equilibrium of the wood that does not allow the drying process to initiate. The Tg value of the type of wood that is being submitted to the drying process may be obtained directly from available literature or determined in laboratory, preferentially, with the help of a wood fluency test in increasing temperatures and air humidity saturation. In a general manner, in polymer technology the determination of the glass transition temperature (Tg) is done by the mercury dilatometry technique, whereby a volume versus temperature curve is obtained. Within the glass transition range, the Tg is defined as the point of intersection between the two tangents of the curve. However, more recently the determination of the Tg has been ascertained using two easily handled instruments, which present similar results to the dilatometer. They are the "Thermal mechanical analyzer"—or TMA—and the "Differential scanning calorimeter"—or DSC—(Peyser, 1989). It must be made clear, however, that other methods known to those versed in the matter may be employed and that the choice of the most appropriate method is not critical to the process of the invention.

The following stage is the actual drying. Once the heating phase is over the drying phase commences, when the glass transition temperature of lignin is maintained together with a humidity equilibrium equal to that of the final humidity intended for the wood. This should remain for a time period sufficient enough for the wood to attain the intended humidity ratio. As mentioned above, the intended humidity ratio depends on a series of factors, such as the conditions of use (temperature and relative humidity of the air), as well as the type of product to be manufactured from the wood.

In the third phase—the cooling—whilst keeping the humidity equilibrium of the wood constant, the load is cooled until the temperature falls below the Tg, preferentially below 40° C. (which is a recommendation of the World Health Organization (WHO) to ensure the welfare of the operators). After this point, the oven may be opened and the load removed. Optionally, before cooling, the conditioning and uniformity phases may be undertaken. These phases allow the final humidity of the load to be evenly distributed or to have a minimum variation within and between the pieces, as well as to have a minimum of drying stress. Basically, the conditioning phase consists in significantly raising the relative air humidity in a manner as to again humidify the outer layers of the pieces, lessening the humidity gradient or also raising the temperature (to about 100° C.) so as to release the drying stress gradients.

The unloading, as well as the loading, should occur in accordance with the procedures known to those versed in the matter, taking into consideration all the precautions required in the traditional process, such as the storage of the dried wood in a ventilated, dry place, protected from the direct action of sunlight or rain.

Another aspect of the present invention refers to the control of the process, in the heating, actual drying, uniformity, conditioning and cooling phases. The control is based on the monitoring of the temperatures of the woods by means of thermocouples placed inside the pieces, during the drying.

FIG. 1 illustrates the positioning of these thermocouples inside the pieces of wood. Thermocouple 1 measures the temperature at the middle of the piece of wood, thermocouple 2 measures the at the surface of the of the piece and thermocouple 3 measures the temperature of the air. The placing of the planks inside the oven is also shown (4) as well as the location of the ventilators (5) and the radiators (6).

Figure 2:
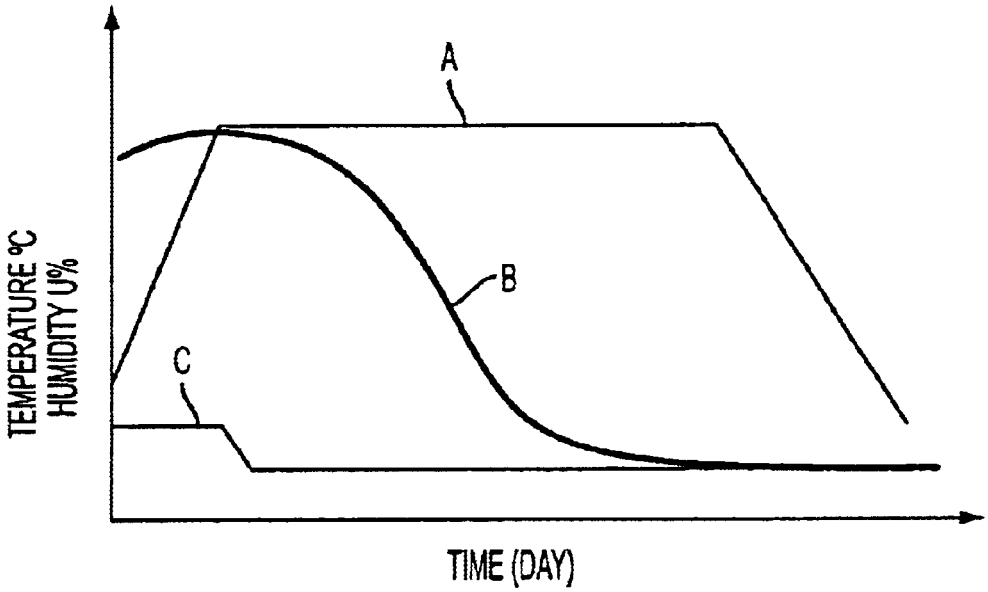
FIG. 2: shows the kinetics of drying following table 3, where the glass transition temperature of lignin (Tg) and the humidity equilibrium of wood (UE) is used.

Table 3 shows, generally, the drying phases of the wood by the method proposed, where the use of the Tg temperature is shown for the different phases of heating and actual drying, as described above. FIG. 2 shows the kinetic theory of drying wood, by the process of drying at glass transition temperature presently proposed, where A represents the heating curve, whose temperature is maintained at Tg during the actual drying, B corresponds to the humidity of the wood and C to the humidity equilibrium.

TABLE 3

Accelerated industrial drying program for sawn wood, by the process intended by this invention.

| Humidity of the wood (%) | Temperature dry bulb (° C.) | Humidity equilibrium (HE) (%) |
|---|---|---|
| Heating | Tg | 20 |
| Green | Tg | programmed ending |
| Uniformity | Tg | programmed ending |
| Cooling | 40 | ambient |

The present invention is described in detail through the examples presented below. It becomes necessary to point out that the invention is not limited to these examples but also includes variations and modifications within the scope of which it functions.

EXAMPLE 1

Determination, in laboratory, of the glass transition temperature of lignin of the tauari wood species (*Couratari guianensis*) and other woods of economic interest.

Figure 3:
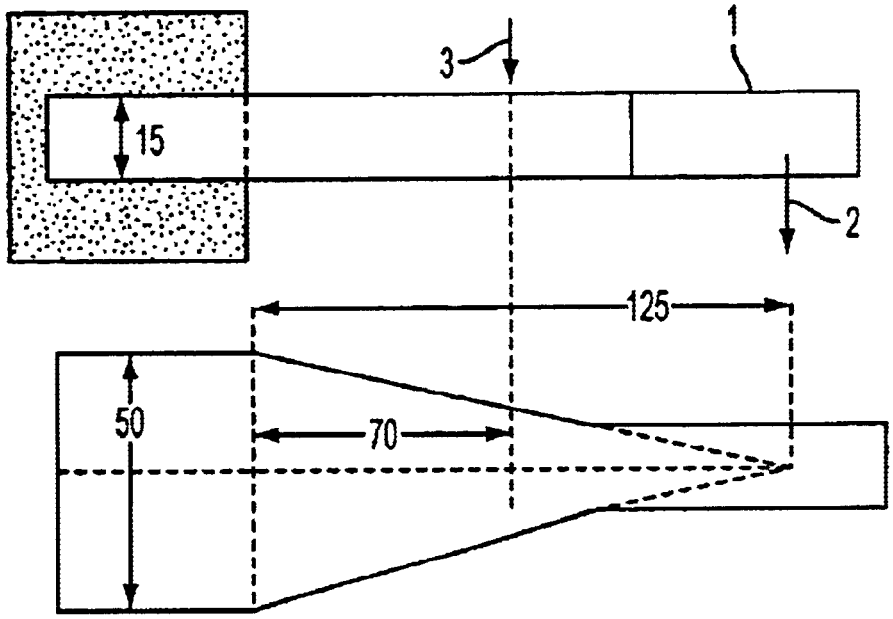
FIG. 3: illustrates the geometrical configuration of the sample body (mm) and the mechanical demands (load) employed in determining the glass transition temperature.

The technique employed originated from an adaptation of a Rheological fluency test for wood developed by the Engref. This may be summarized in the following manner: the wood sample (1) is submitted to a mechanical demand or loading (2) constant in time, as shown in FIG. 3, following which the set is placed in an autoclave fitted with a programmable thermal regulation device of the Proportional Integrate Derivative (PID) type.

The tests have only one phase, during which the temperature increase is linear in function of time until a temperature of 120° C. is attained (the maximum safe temperature of the autoclave). During the test, the deformation of the test sample is constantly monitored, in function of temperature and time, by an electronic comparator (3) of the LDVT type, located at 70 cm from the subjection point of the sample.

Figure 4:
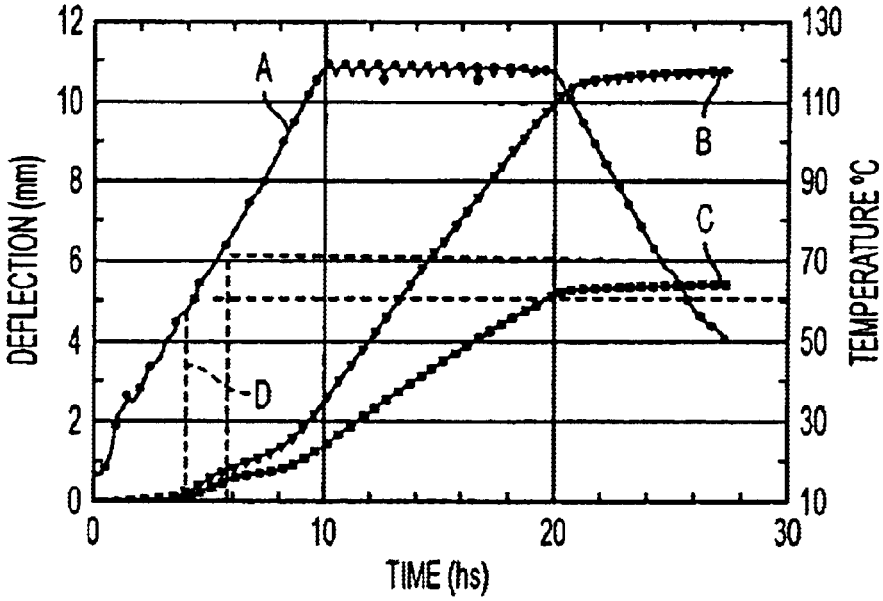
FIG. 4: shows the curve for determining the temperature of glass transition for leaf tree species.

Various tests were undertaken. FIGS. 3 and 4 represent typical fluency examples of two types of wood.

In FIG. 4 it is possible to see the transition zone determined for tauari wood. The heating, or temperature curves (A) and the fluency curves of tauari samples with 315 g (B) and 100 g (C), are represented. Two different load sizes were used to demonstrate that the glass transition phenomenon depends more on temperature than the mass of the load. The glass transition point, or phase (D), determined by the beginning of marked deflection of the B and C curves, occurs between 60° C. and 100 ° C., which is a characteristic of leafy species, which is the case of tauari, eucalyptus, oak, etc. It can also be noted that there is a leveling out of the deformations of the wood when the effect of the temperature wears off, after the 20th hour of the experiment.

Figure 5:
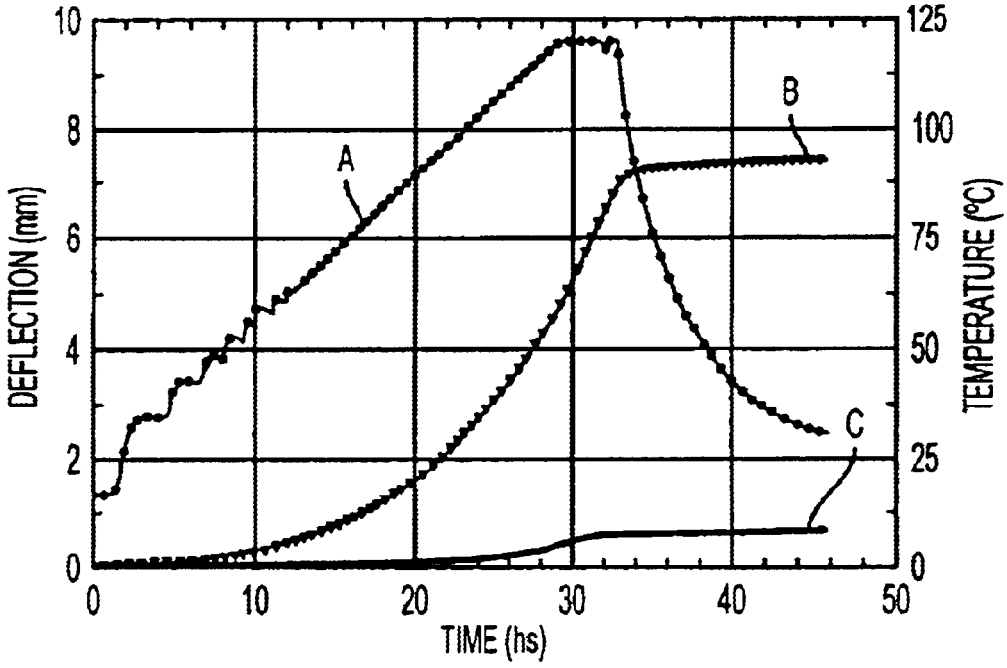
FIG. 5: shows the curve for determining the temperature of glass transition for conifers.

FIG. 5, where the wood fluency of the conifer epicia was tested, also represents the heating curve (A), and the curves corresponding to a sample (load) of 315 g (B) and a sample without load (C). In this case, the glass transition range was not encountered, with the deflection of the curve being gentle and constant in response to the effect of the temperature. However, the phenomenon should occur at a temperature above 120° C., which is a characteristic of the conifer woods studied—the same happened with the tests with wild pines amongst other conifers studied. In the test represented by FIG. 5, it is possible to observe the bursting of one of the samples at an approximate temperature of 120° C., caused by a natural defect of the wood.

EXAMPLE 2

The purpose of this example is to demonstrate the heating of the load to the glass transition temperature of lignin obtained in Example 1, and keeping this temperature for an adequate period of time, until obtaining the intended humidity ratio.

Depending on, principally, the performance and the maintenance conditions of the industrial dryer, as well as the nominal availability of thermal energy, it is possible to use, in this manner, any temperature within the glass transition range of the wood.

Figure 6:
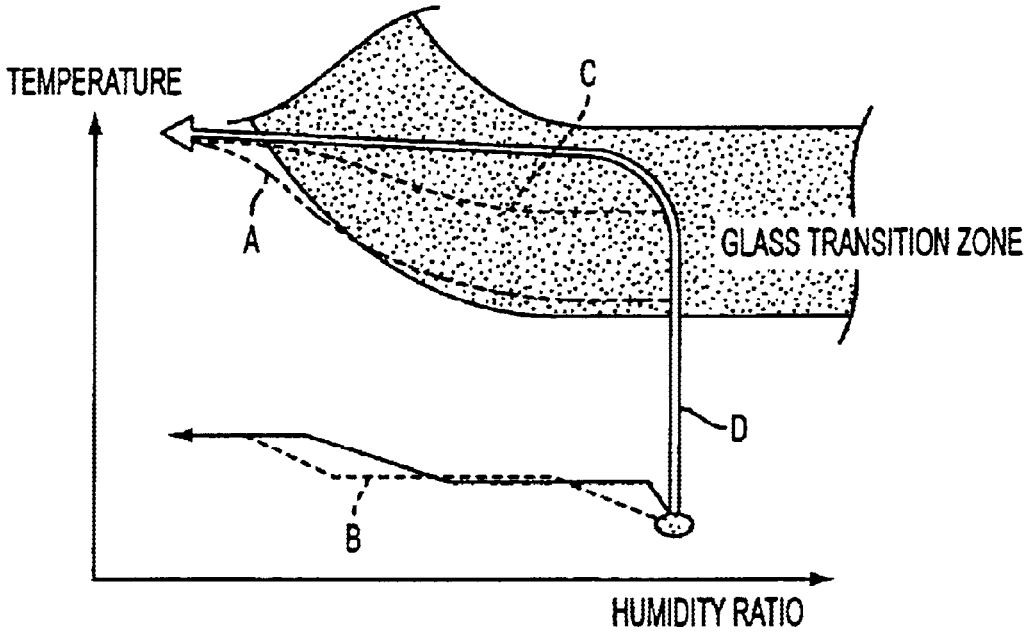
FIG. 6: shows a comparison of the traditional industrial drying processes for wood, with the process of the present invention.

FIG. 6 shows, comparatively, the drying processes at high temperature (A), at low temperatures (B) and the present process by glass transition temperature (C). The solid line (D) shows the effect of the temperature on the middle of the piece of wood both for the high temperature process and the present process.

Table 4 shows the relative data for the drying of sawn tauari wood, by the glass transition temperature drying process.

TABLE 4

Drying of sawn tauari wood, by the glass transition temperature drying process: temperature and time used.

| Stage of the drying process | Humidity of the wood (%) | Temperature of dry bulb (° C.) | Humidity equilibrium (%) | Time (day) |
|---|---|---|---|---|
| Heating | Green | 95.0 | 15.0 | 1.3 |
| Drying | Green | 95.0 | 12.0 | 3.0 |
| Unif./Cond. | 12.0 | 95.0 | 12.0 | 0.0 |
| Cooling | 12.0 | <40.0 | 12.0 | 1.0 |

Figure 7:
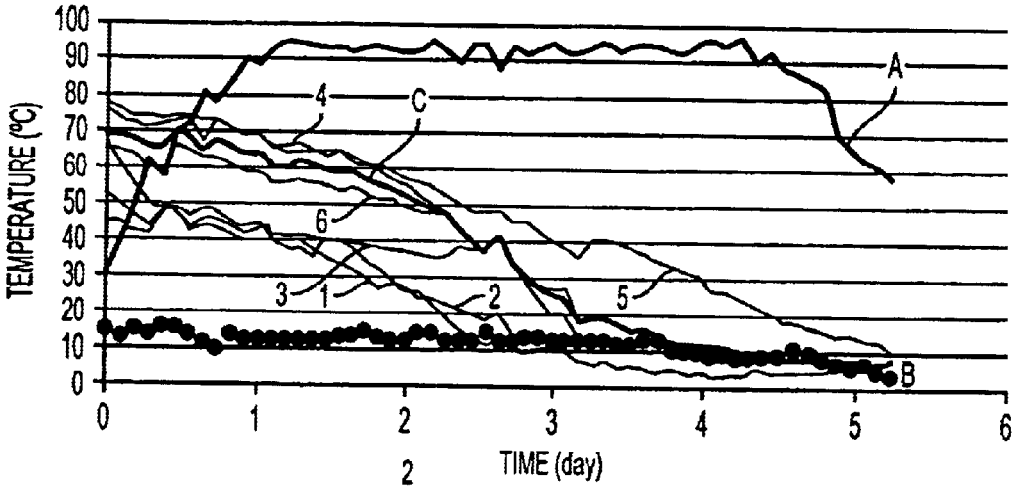
FIG. 7: illustrates the drying curves for sawn tauari wood using the process of the present invention.

FIG. 7 shows the variation in the time and temperature of the heating drying and cooling of a load of tauari wood having a thickness of 45 mm. The various curves presented correspond to: Temperature of dry bulb (A); Humidity equilibrium in air (B); Average humidity of the load (C) and Humidity of each piece (1, 2, 3, 4, 5 and 6).

As shown by FIGS. 6 and 7 and on Table 4, a temperature close to the maximum limit within the glass transition temperature range, as determined by the fluency test, was used for this example.

EXAMPLE 3

The objective of this example is to demonstrate how the pieces of wood dried by the process of this invention maintain their quality.

The load of wood was evaluated before the beginning of the drying process. Each piece from the sample was numbered and registered on field notes, which noted the presence or absence of flaws, and would serve at the end of drying as a parameter for comparison.

After the drying period of the wood, another evaluation took place, specifically for the previously numbered pieces. The comparison of the information revealed that the pieces did not present any sort of splitting and that only 0.6% retained the warping detected before the drying process.

Warps occur, principally, due to the large variations in the size of the pieces, which is mainly justified by the large wear levels of the band saw machines, as well as the poor quality of the tauari logs.

Another remarkable aspect observed during the quality evaluation after employing the drying process of the present invention was the presence of a more accentuated coloration (darker) of the wood.

This phenomenon is due to the effect of the rapid displacement of water from the middle of the piece of wood to its surface—both in liquid and vapour form—where these extractive particles (resins, pigments, amongst other incidental elements of wood) are transported to the surface, where—as the vapour is less dense and has a better diffusion in air—these particles are consequently deposited, providing the wood with a deeper coloring.

As this colour change is the result of the accumulation of extractives at the surface, there is no harm to the industrial use of the wood since, as in the case of tauari, in the majority of cases the surface is removed and the piece returns to its normal colour

What is claimed is:

1. A process for accelerated drying of wood based on its rheological properties comprising the following stages:

(i) monitoring the temperature of the wood using thermal sensors;

(ii) heating the wood inside an oven, for a time necessary to attain a temperature Tg within a glass transition temperature range of lignin;

(iii) actual drying, by maintaining the temperature within the glass transition temperature range of lignin, over a period of time sufficient for the wood to attain a humidity equilibrium equal to a final humidity intended for the wood based upon conditions of use;

(iv) cooling the wood, whilst maintaining the humidity equilibrium of the wood constant, until a temperature inferior to the Tg of lignin is attained; and (v) optionally, subjecting the wood to uniformity and conditioning processes before stage (iv).

2. The process according to claim 1, wherein in stage (i) a first thermal sensor measures the temperature at the interior of the wood, a second thermal sensor measures the temperature at the surface of the wood and a third thermal sensor measures air temperature inside the oven.

3. The process according to claim 2, wherein significant temperature gradients between the interior and the surface of the wood should be avoided so that the difference in temperature between the interior and the surface remains in a range from 2 to 5° C.

4. The process according to claim 1, wherein in stage (ii) the Tg within the glass transition temperature range of lignin is accompanied by a humidity that does not allow the drying process to commence.

5. The process according to claim 4, wherein the humidity is of 20%.

6. The process according to claim 1, wherein in stage (iii) the final humidity intended for the wood remains in a range from 5 to 20%.

7. The process according to claim 1, wherein in stage (iv), the cooling is carried out at a temperature below 40° C.

8. The process according to claim 1, wherein the wood is *Couratari guianensis* with a dry bulb Tg of 95° C. and a humidity equilibrium during actual drying of 12%.

9. The wood obtained in accordance with the process of claim 1.

* * * * *